US010882210B2

(12) United States Patent
Lovinsky

(10) Patent No.: US 10,882,210 B2
(45) Date of Patent: Jan. 5, 2021

(54) SYSTEM AND METHOD OF MAKING WOOD CURLS

(71) Applicant: James Lovinsky, East Hardwick, VT (US)

(72) Inventor: James Lovinsky, East Hardwick, VT (US)

(73) Assignee: Eastview Enterprises, Inc., East Hardwick, VT (US)

( * ) Notice: Subject to any disclaimer, the term of this patent is extended or adjusted under 35 U.S.C. 154(b) by 330 days.

(21) Appl. No.: 15/808,041

(22) Filed: Nov. 9, 2017

(65) Prior Publication Data

US 2018/0126583 A1 May 10, 2018

Related U.S. Application Data

(60) Provisional application No. 62/419,937, filed on Nov. 9, 2016.

(51) Int. Cl.

| | |
|---|---|
| ***B27L 11/02*** | (2006.01) |
| ***B27L 11/00*** | (2006.01) |
| ***B27G 13/10*** | (2006.01) |

(52) U.S. Cl.

CPC ..... *B27L 11/02* (2013.01); *B27G 13/10* (2013.01); *B27L 11/005* (2013.01)

(58) Field of Classification Search

CPC ..... B27L 11/00; B27L 11/005; B27L 11/02; B27L 11/04; B27L 11/08

See application file for complete search history.

(56) References Cited

U.S. PATENT DOCUMENTS

| | | | |
|---|---|---|---|
| 4,493,352 | A | 1/1985 | Jaakonmaki et al. |
| 5,097,879 | A | 3/1992 | Rice |
| 5,261,469 | A | 11/1993 | Severson |
| 5,762,122 | A | 6/1998 | Rice |
| 7,201,339 | B2 | 4/2007 | Ford |
| 2006/0060264 | A1 | 3/2006 | Glover et al. |

FOREIGN PATENT DOCUMENTS

CA 630297 * 11/1961

OTHER PUBLICATIONS

W. B. Webb, Drying System Theory, Sep. 29, 2015, https://www.jacksonlbrharvester.com/webbwhitepaper.html (Year: 2015).*

* cited by examiner

*Primary Examiner* — Matthew Katcoff

(74) *Attorney, Agent, or Firm* — Shawn Gordon, Esq.; Dunkiel Saunders Elliott Raubvogel & Hand, PLLC

(57) ABSTRACT

A system and method are provided for producing wood curls with reliable consistency and resiliency. Moisture content of wood blocks is determined and a plurality of cutting knives are installed on a disc of a curling machine and set to extend about 0.012 inches from the face of the disc. The wood blocks are fed through the curling machine and the feed rate is set based on the moisture content of the blocks and the sharpness of the cutting knives and readjusted based on the resiliency of previously cut curls in order to produce wood curls of a desired resilience.

14 Claims, 2 Drawing Sheets

SYSTEM AND METHOD OF MAKING WOOD CURLS

RELATED APPLICATION DATA

This application claims the benefit of priority of U.S. Provisional Application No. 62/419,937, filed Nov. 9, 2016, and titled "System and Method of Making Wood Curls," which is incorporated by reference herein in its entirety.

FIELD OF THE INVENTION

The present invention generally relates to wood processing. In particular, the present invention is directed to a system and method of making wood curls.

BACKGROUND

Many devices and methods are known for wood machining that create wood chips for different applications. One exemplary process is known as peripheral milling, which is largely concerned with manipulating the work piece to a desired shape and surface, with the production of wood chips merely a byproduct of the process. Peripheral milling typically involves a rotary cutting process in which wood is removed in the form of single chips. The chips are formed by the intermittent engagement of the work piece by knives carried on the periphery of a rotating cutter head.

Another exemplary process is known as orthogonal cutting for producing wood chips or flakes. In orthogonal cutting, the cutting edge is generally perpendicular to the direction of the relative motion of tool and work piece and the surface generated is in a plane parallel to the original work surface. These chipping machines reduce pulpwood to more or less uniform chips and most include a heavy rotating steel disc that is slotted on the face to receive chipping knives. Wood is presented to the rotating disc so that the knives remove chips. Wood chippers of this kind typically have a cutting action whereby the knives cut essentially through a cross section of the wood fibers to produce either a flat or curled wood flake depending on the conditions. Curled wood flakes have many applications, including being used for packing and potpourri material.

One known factor in determining whether a wood chip or flake will be flat or curled is the rake angle. In the nomenclature of wood machining, the rake angle is often defined as the angle made between the tool face and a plane perpendicular to the direction of tool travel. Large rake angles are typically used to produce flat wood particles and relatively small rake angles are used to produce wood curls. For wood curls, the consistency and resiliency of the curl can be an important attribute, but the rake angle fails to solely account for these properties. There is a need therefore for a way to reliably produce wood curls with a desired consistency and resiliency.

SUMMARY OF THE DISCLOSURE

A method of producing wood curls is provided that includes determining a moisture content of a plurality of wood blocks, arranging a plurality of knives on a disc of a curling machine, wherein the plurality of knives each protrude from a face of the disc from about 0.011 inches to about 0.013 inches, and determining a sharpness of the plurality of knives. Then one of the plurality of wood blocks is fed through the curling machine at a feed rate, wherein the feed rate is based upon the moisture content of the plurality of wood blocks and the sharpness of the plurality of knives. The one of the plurality of wood blocks is cut with the plurality of knives into curls and a thickness of the curls is assessed, at which point the feed rate is adjusted based on the thickness of the curls so that subsequent wood curls produced from other ones of the plurality of wood blocks will have a thickness closer to 0.012 inches by at least adjusting an amount of air released from a muffler on an air/hydraulic manifold of the curling machine.

In another aspect, a method of producing wood curls is provided that includes determining a moisture content of a wood block and arranging a plurality of knives on a disc of a curling machine, wherein the plurality of knives each protrude from a face of the disc from about 0.011 inches to about 0.013 inches. A sharpness of the plurality of knives is determined and the wood block is fed through the curling machine at a feed rate, wherein the feed rate is based upon the moisture content of the wood block and the sharpness of the plurality of knives, and the wood block is cut into curls having a desired resilience.

In another aspect, a system for producing wood curls is provided that includes a wood block having a moisture content and a hardness, a curling machine having a rotary disc, the rotary disc including a face, and a plurality of cutting knives having a sharpness and being installed on rotary disc such that the cutting knives protrude about 0.011 inches to about 0.013 inches from the face of the rotary disc. The wood block passes through the curling machine at a feed rate such that the cutting knives cut the wood block to form wood curls having a resilience, and the feed rate is adjusted based on the sharpness of the plurality of cutting knives and the moisture content and the hardness of the wood block so that the resilience of the wood curls is such that the wood curls, when dried, are suitable for use as a packing material that does not readily collapsing in a container when pressured by items contained in the container.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A system and method of making wood curls as disclosed herein produces a wood curl with properties that are desirable for the packaging and shipment of materials, among other uses. Curled wood shavings produced in accordance with the present disclosure are lightweight, relatively dust free, elastic, inexpensive, and environmentally safe to manufacture and use. Curled shavings produced as described herein have a resiliency that is not overly stiff and thus can be poured around an object being packed and conform to the object's shape while requiring less manual arrangement than excelsior-like materials. The wood curls produced in accordance with the present invention also consistently have the appropriate resiliency so as to avoid being crushed during packing, which reduces the chance of the creation of voids within the packaging container that may result in damaged product.

Figure 1:
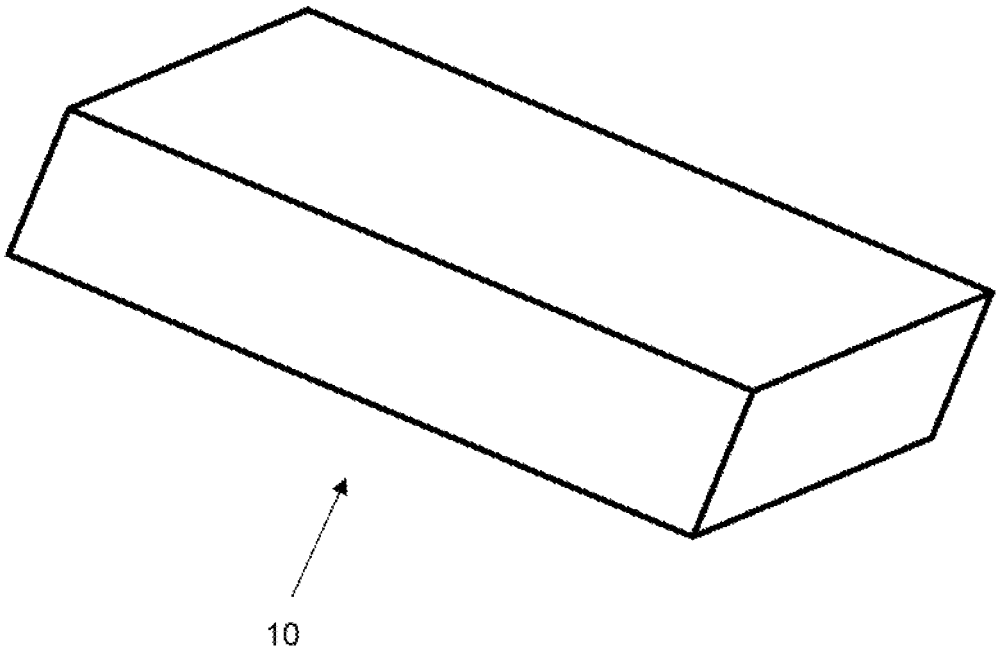
FIG. 1 is an exemplary wood block used for making wood curls in accordance with an embodiment of the present invention.

At a high level, the process for producing wood curls begins with the preparation of raw wood materials to be chipped. In an exemplary embodiment, raw materials are in the form of wood blocks, such as wood block 10 in FIG. 1, that are cut to predetermined specifications with respect to height, width, depth, and cut angle. The height determines the length of the curl to be produced. The width can be no more than a maximum width so as to allow wood block 10 to fit into a feed chute of a chipper or curling machine. The cut angle is the angle to which the wood blocks are cut in order for the wood blocks to feed through the curling machine.

Generally, creation of wood curls involves feeding the wood blocks into a chute of a curling mill, which includes a hydraulic ram to push the blocks at a feed rate toward a disc of a chipping machine that shaves the wood blocks into curls. The curls are taken out of the chipping machine via a belt conveyor and passed over an off-balance conveyor that separates out dust and fines. The curls drop off onto another belted conveyor and then go through dryers, such as two gas-fired rotary driers, to remove moisture to dry and set the curls. The curls leave the second dryer and are fed via another belted conveyor onto a second shaker to remove any dust or fines remaining after drying. The curls are then fed via a belted conveyor into large hoppers to cool. From the large hoppers the curls can be loaded into bags or cartons for shipping or storage.

While many factors in the set up and operation of the shaving/curling machine determine the qualities of the curls produced, the thickness of cut drives many of the desirable curl qualities.

In an exemplary embodiment, wood curls are produced that are about 2.75 inches long and have a width of about 1.0 inch, although curls with different lengths and/or widths may be produced. In order to produce a stable and consistent curl with less waste material, however, the thickness of the curl must be between about 0.011 and 0.014 inches. In a preferred embodiment, the width of the curl is about 0.012 inches. Curls with a thickness below about 0.0105 inches will result in curls with little resiliency.

The thickness of the curls produced is determined in part by how cutting knives are set in a curling machine. In general, a plurality of planer knives are held in a rotating disc of a curling machine and set. In an exemplary embodiment, four cutting knives and two sets of scoring knives are included with the disc, wherein the scoring knives determine the width of the curls.

In an exemplary embodiment, the curling machine includes a disc that has four slots with holding blocks to install the cutting knives. In this embodiment, the cutting knives are in sets of four and marked accordingly to keep the cutting knives in sets. The disc slots are designated one through four as the disc is rotated clockwise. The slot designated as one is the slot following the keyway on the rotator shaft and the slot designated as four is the slot over the keyway.

The knives may be removed by loosening the mounting bolts and extracting the knives. Residue from the cutting/chipping operation may be removed when the knives are removed.

Beginning with slot number 1 in the disc, the disc is rotated clockwise until the slot is at about a three o'clock position. This allows lock washers to fall away so the knives can be installed between the block and the lock washers. A first knife is installed, and then the disc is rotated to the nine o'clock position and the bolts are tightened so that the edge of the knife is set with no projection beyond the face of the disc. In this manner, all four knives may be installed without damaging the edges when the disc is rotated.

Once all four knives are in place in the slots of the disc, the depth of the installed knives is set. Starting with knife in slot one, a depth miter gauge is used to set each of the knives to 12/1000th of an inch out from the face of the disc.

Once depth is set for all four cutting knives, the disc is reloaded in the curling machine, and blocks can be loaded into the feed chute. A piston feeds the blocks to the cutting disc at a feed rate. Once a load of blocks is completed, the piston will automatically return to the home position and allow for another load of wood blocks to be processed. Setting the depth of the cutting knives as described above step will result in wood curls with a thickness of about 12/1000th inch. However, minor variations may occur due to differences in the properties of the wood blocks used, such as moisture content, age, and hardness, as well as variation in the sharpness of the knives. Any such variations may be compensated for by adjusting the rate of feed of blocks into the curling machine. The rate of feed can be controlled, at least at a basic level, via a knob or the like.

The feed rate (and return rate) can be further fine-tuned by adjusting the amount of air allowed to be released from a muffler on the air/hydraulic manifold. The main purpose of the manifold is to purge air from the hydraulic system, but the manifold can also be used to in this way to allow further refined adjustments to the feed rate. Adjustments to the feed rate may be necessary in order to obtain wood curls with the desired resiliency due to variations in the wood blocks and sharpness of the knives, so curls produced from an initial load may be inspected and adjustments to the feed rate made if needed.

The wood blocks are fed through the disc using an air over hydraulic ram system. The load chute is off-set 90 degrees from the disc and also has a slight incline. Typically, an operator loads the chute and manually trips the feed mechanism.

After being cut from the wood blocks, the curls pass over two shakers that remove dust and fines from the curls. One is before the drying process and other follows the drying process. Double shaking ensures the processed curls are mostly free of dust and fines created during the cutting and drying processes.

Curls are optimally created using fresh wood that has not lost much moisture content, as such wood is easier on the knives. Fresh poplar, for example, can have as much as 30% moisture content. After the wood is cut, the drying process removes moisture down to 3-4%, which serves to "set" the curls.

Figure 2:
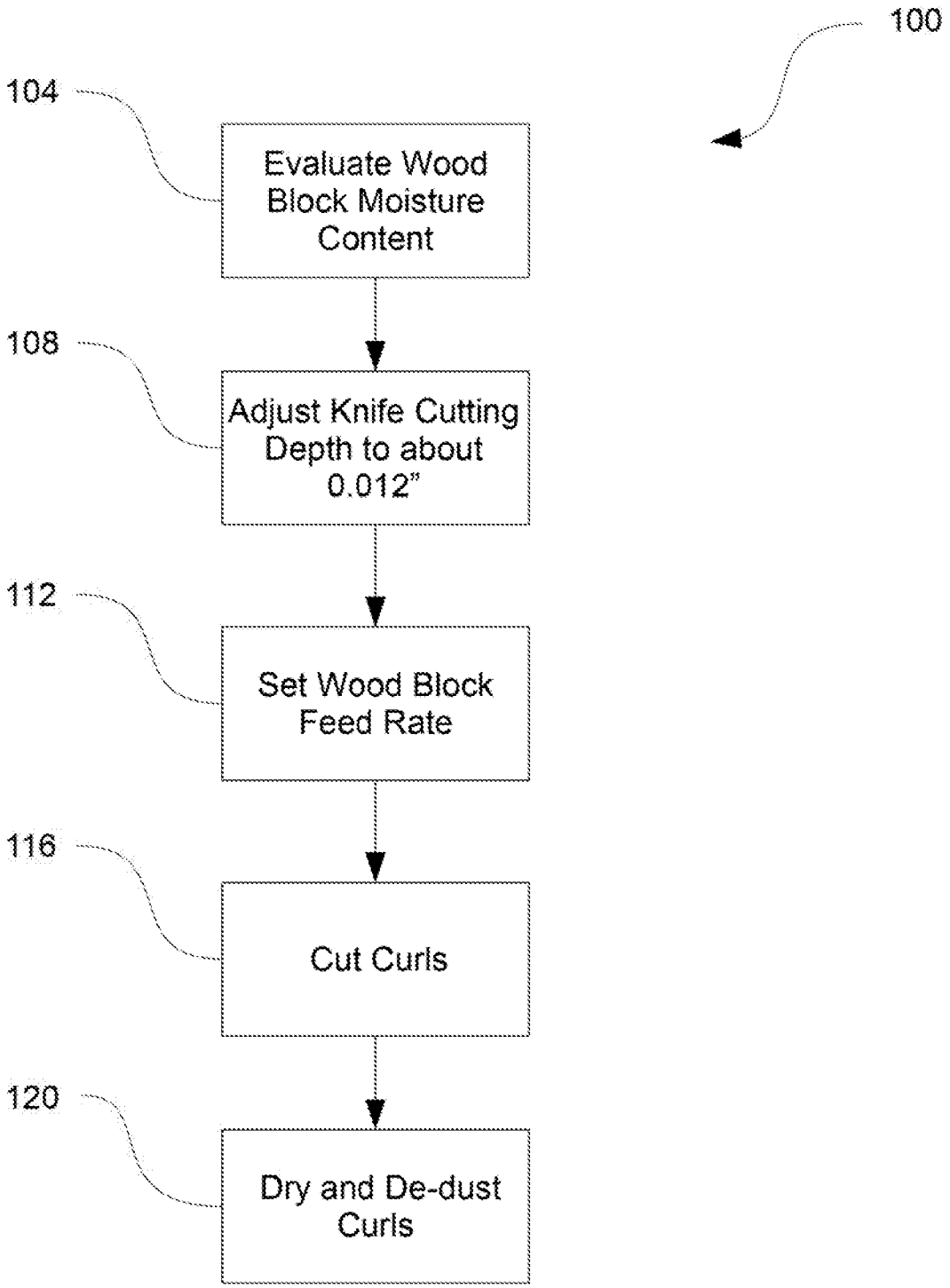
FIG. 2 is a block diagram of an exemplary wood curl process according to an embodiment of the present invention.

Turning specifically to FIG. 2, the moisture content of the wood blocks is evaluated at step 104. This can be conducted using a moisture sensor or via other methods known in the art. At step 108, the knife depth is adjusted to about 0.012 inches beyond the face of the cutting disc. At step 112, the feed rate of the wood blocks is set based upon the moisture content and perceived blade sharpness. At step 116, the curls are cut. At step 120, the curls are dried and de-dusted. The process produces a wood curl with a desired resilience, which is a resilience that is suitable for use as a packing material without readily collapsing in the container when pressured by the items contained therein.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of producing wood curls comprising:

determining a moisture content of a plurality of wood blocks;

arranging a plurality of knives on a disc of a curling machine, wherein the plurality of knives each protrude from a face of the disc from 0.011 inches to 0.013 inches;

determining a sharpness of the plurality of knives;

feeding one of the plurality of wood blocks through the curling machine at a feed rate, wherein the feed rate is based upon the moisture content of the plurality of wood blocks and the sharpness of the plurality of knives;

cutting with the plurality of knives the one of the plurality of wood blocks into curls;

assessing a thickness of the curls; and adjusting the feed rate based on the thickness of the curls so that subsequent wood curls produced from other ones of the plurality of wood blocks will have a thickness closer to 0.012 inches by at least adjusting an amount of air released from a muffler on an air/hydraulic manifold of the curling machine.

2. The method of claim 1 further including a step of drying the subsequent wood curls to a moisture content of about 4%.

3. The method of claim 2 further including a step of de-dusting the subsequent wood curls.

4. The method of claim 3 further including:

passing the subsequent wood curls over an off-balance conveyor that separates out dust and fines;

dropping the subsequent wood curls into gas-fired rotary dryers to remove moisture so as to dry and set the wood curls; and shaking the subsequent wood curls on a belted conveyor to remove any dust or fines remaining after drying.

5. A method of producing wood curls comprising:

determining a moisture content of a wood block;

arranging a plurality of knives on a disc of a curling machine, wherein the plurality of knives each protrude from a face of the disc from 0.011 inches to 0.013 inches;

determining a sharpness of the plurality of knives;

feeding the wood block through the curling machine at a feed rate, wherein the feed rate is based upon the moisture content of the wood block and the sharpness of the plurality of knives; and cutting the wood block into curls having a desired resilience.

6. The method of claim 5 further including a step of adjusting the feed rate such that cutting the wood block into curls produces wood curls with a resilience such that the wood curls, when used as a packing material, resist collapsing in a container when pressured by items contained in the container.

7. The method of claim 5 further including a step of drying the curls to a moisture content of about 4%.

8. The method of claim 5 further including a step of de-dusting the curls.

9. The method of claim 6 further including a step of adjusting an amount of air released from mufflers on an air/hydraulic manifold of the curling machine in order to fine tune the feed rate.

10. The method of claim 5 further including:

passing the wood curls over an off-balance conveyor that separates out dust and fines;

dropping the wood curls into gas-fired rotary dryers to remove moisture to dry and set the wood curls; and shaking the wood curls on a belted conveyor to remove any dust or fines remaining after drying.

11. A system for producing wood curls comprising:

a wood block having a moisture content and a hardness;

a curling machine having a rotary disc, the rotary disc including a face; and a plurality of cutting knives having a sharpness and being installed on the rotary disc such that the cutting knives protrude 0.011 inches to 0.013 inches from the face of the rotary disc, wherein the wood block passes through the curling machine at a feed rate such that the cutting knives cut the wood block to form wood curls having a resilience and wherein the feed rate is adjusted based on the sharpness of the plurality of cutting knives and the moisture content and the hardness of the wood block so that the resilience of the wood curls is such that the wood curls, when dried, are suitable for use as a packing material that does not readily collapsing in a container when pressured by items contained in the container, and wherein the curling machine includes an air/hydraulic manifold with a muffler and the feed rate can be fine-tuned by adjusting an amount of air released from the muffler.

12. The system for producing wood curls according to claim 11 further including a dryer for drying the wood curls, wherein the dried wood curls have 4% moisture.

13. The system for producing wood curls according to claim 11 further including two scoring knives spaced about 1 inch apart.

14. The system for producing wood curls according to claim 11 wherein the wood block has a length of about 2.75 inches.

* * * * *